US007575840B2

(12) United States Patent
Teramoto et al.

(10) Patent No.: US 7,575,840 B2
(45) Date of Patent: Aug. 18, 2009

(54) TONER FOR DEVELOPING ELECTROSTATIC LATENT IMAGE AND IMAGE FORMING METHOD USING THE SAME

(75) Inventors: Kouzou Teramoto, Osaka (JP); Yukinori Nakayama, Tsu (JP); Kousuke Satou, Ise-si (JP); Hiroshi Mizuhata, Wakayama (JP)

(73) Assignee: Kyocera Mita Corporation, Osaka (JP)

( * ) Notice: Subject to any disclaimer, the term of this patent is extended or adjusted under 35 U.S.C. 154(b) by 564 days.

(21) Appl. No.: 11/396,389

(22) Filed: Mar. 31, 2006

(65) Prior Publication Data

US 2006/0222984 A1 Oct. 5, 2006

(30) Foreign Application Priority Data

Mar. 31, 2005 (JP) ..... 2005-104867

(51) Int. Cl.
*G03G 9/00* (2006.01)

(52) U.S. Cl. ..... 430/106.1; 430/110.4; 430/122.5; 430/122.51

(58) Field of Classification Search ..... 430/106.1, 430/110.4, 122.5, 122.51
See application file for complete search history.

(56) References Cited

U.S. PATENT DOCUMENTS 7,410,740 B2 * 8/2008 Nakayama et al. ..... 430/108.1

FOREIGN PATENT DOCUMENTS

| | | | |
|---|---|---|---|
| JP | 9-59024 | A | 3/1997 |
| JP | 11-153882 | A | 6/1999 |
| JP | 11-288125 | A | 10/1999 |
| JP | 2000-162817 | A | 6/2000 |
| JP | 2000-242029 | A | 9/2000 |

* cited by examiner

*Primary Examiner*—Mark A Chapman

(57) ABSTRACT

The toner of the present invention is characterized in that the charges rise up rapidly, the charge quantity is not insufficient nor excessive, the photoreceptor contamination is minimized and the toner is endurable under harsh conditions and against the high stress usage. The magnetic particle contained in the toner is of average particle size 0.01 μm through 0.50 μm, is of octahedron shape that is a convex polyhedron surrounded by eight triangles as a basis, each of vertexes and edges of the octahedron being in a curved surface shape and having a portion that can be taken as a straight line on the outer periphery of a projected image of said octahedron. The sphericity of the toner is 0.94 through 0.98. Here, the sphericity is defined by C2/C1, where C1 is a circumferential length of an image projected on a plane and C2 is a circumferential length of an assumed circle area as same as that of the projected image. Further, a number content of the toner of particle size 0.6 μm through 2.0 μm is smaller than 10%.

4 Claims, 8 Drawing Sheets

FIG. 5

| | AVERAGE SIZE(μm) | SPHERICITY | FINE PARTICLE NUMBER CONTENT % | MAGNETIC PARTICLE | |
|---|---|---|---|---|---|
| | | | | SHAPE | TAPER |
| EX. 1 | 7.1 | 0.941 | 8.2 | OCTA | TPI |
| EX. 2 | 7.2 | 0.953 | 8.5 | OCTA | TPI |
| EX. 3 | 6.9 | 0.967 | 3.6 | OCTA | TPI |
| EX. 4 | 6.7 | 0.976 | 9.1 | OCTA | TPI |
| REF. 1 | 6.5 | 0.99 | 6.7 | OCTA | TPI |
| REF. 2 | 6.9 | 0.963 | 12.9 | OCTA | TPI |
| REF. 3 | 7.1 | 0.918 | 9.1 | OCTA | TPI |
| REF. 4 | 6.9 | 0.967 | 3.6 | OCTA | TH |
| REF. 5 | 7.2 | 0.955 | 4.5 | HEXA | TH |
| REF. 6 | 6.9 | 0.967 | 3.6 | SPH | – |

TPI: tapered in accordance with the present invention

TH: heavily tapered

FIG. 6

| OT/OH | DENSITY (CONTINUOUS) | | IMAGE DEFECT | | FINELINE/TRANSFER FALL | | DENSITY (INTERMITTERNT) | | CHARGE(μ C/g) |
|---|---|---|---|---|---|---|---|---|---|
| | INITIAL | 300K PRINTS | INITIAL | 300K PRINTS | INITIAL | 300K PRINTS | INITIAL | 100K PRINTS | AFTER INSTALL |
| EX. 1 | 1.42 | 1.32 | ○ | ○ | ○ | ○ | 1.41 | 1.36 | 5.4 |
| EX. 2 | 1.43 | 1.4 | ○ | ○ | ○ | ○ | 1.43 | 1.34 | 6.1 |
| EX. 3 | 1.39 | 1.33 | ○ | ○ | ○ | ○ | 1.39 | 1.37 | 6.5 |
| EX. 4 | 1.39 | 1.33 | ○ | ○ | ○ | ○ | 1.39 | 1.39 | 7.2 |
| REF. 1 | 1.42 | - | ○ | - | ○ | - | 1.4 | - | 6.8 |
| REF. 2 | 1.28 | 1.01 | ○ | × | ○ | × | 1.26 | 0.87 | 7.5 |
| REF. 3 | 1.35 | 1.06 | ○ | × | × | × | 1.36 | 1.01 | 5.9 |
| REF. 4 | 1.38 | 1.25 | ○ | △ | △ | △ | 1.32 | 1.18 | 6.5 |
| REF. 5 | 1.3 | 1.15 | ○ | × | △ | △ | 1.3 | 0.82 | 8 |
| REF. 6 | 1.28 | 0.9 | ○ | × | △ | × | 1.27 | 0.74 | 9 |

FIG. 7

| LT/LH | DENSITY (CONTINUOUS) | | IMAGE DEFECT | | CHARGE(μC/g) |
|---|---|---|---|---|---|
| | INITIAL | 300K PRINTS | INITIAL | 300K PRINTS | AFTER INSTALL |
| EX. 1 | 1.38 | 1.38 | ○ | ○ | 6 |
| EX. 2 | 1.44 | 1.43 | ○ | ○ | 6.8 |
| EX. 3 | 1.39 | 1.37 | ○ | ○ | 7.3 |
| EX. 4 | 1.43 | 1.41 | ○ | ○ | 7.8 |
| REF. 1 | 1.4 | – | △ | – | 7.9 |
| REF. 2 | – | – | × | – | 12.3 |
| REF. 3 | 1.35 | 0.91 | ○ | × | 7 |
| REF. 4 | 1.37 | 1.2 | ○ | △ | 6.7 |
| REF. 5 | – | – | × | – | 11.2 |
| REF. 6 | – | – | × | – | 13.7 |

REF. 1: bad cleaning
REF. 2: toner layer turbulence
REF. 3: low image density, photoreceptor contamination
REF. 4: low image density, photoreceptor contamination
REF. 5: toner layer turbulence
REF. 6: toner layer turbulence

FIG. 8

| HT/HH | DENSITY (CONTINUOUS) | | IMAGE DEFECT | | CHARGE(μC/g) |
|---|---|---|---|---|---|
| | INITIAL | 300K PRINTS | INITIAL | 300K PRINTS | AFTER INSTALL |
| EX. 1 | 1.36 | 1.32 | ○ | ○ | 5.1 |
| EX. 2 | 1.4 | 1.35 | ○ | ○ | 5 |
| EX. 3 | 1.35 | 1.3 | ○ | ○ | 5.6 |
| EX. 4 | 1.38 | 1.33 | ○ | ○ | 6.3 |
| REF. 1 | 1.31 | 1.13 | △ | × | 6 |
| REF. 2 | 1.2 | 0.91 | ○ | × | 6.4 |
| REF. 3 | 1.19 | 0.83 | ○ | × | 4.3 |
| REF. 4 | 1.06 | – | ○ | – | 5 |
| REF. 5 | 1.21 | 0.78 | ○ | × | 4.8 |
| REF. 6 | 1.13 | – | ○ | – | 5.6 |

REF. 1: bad cleaning
REF. 3: photoreceptor contamination
REF. 4: low initial image density
REF. 5: photoreceptor contamination
REF. 6: evaluation suspended due to image density drop

TONER FOR DEVELOPING ELECTROSTATIC LATENT IMAGE AND IMAGE FORMING METHOD USING THE SAME

BACKGROUND OF THE INVENTION (1) Field of the Invention

The present invention relates to toner for developing electrostatic latent image and image forming method using the same, particularly to an optimization of the shape of a magnetic particle added in the toner and the shape of the toner.

(2) Description of the Prior Art

In the electro-photographic image forming apparatuses such as laser printers, copiers, facsimiles and their hybrid apparatuses, first, the electrostatic latent image retaining member, i.e., a photoreceptor is electrically charged uniformly, second, the photoreceptor is exposed, thereby forming the electrostatic latent image, third, the latent image is developed by the toner, forth, the toner image is transferred onto the paper, or the intermediate transfer member, and finally the transferred toner image is fixed onto the paper.

Although there are dry and wet developing methods, the dry development is more widely employed than the wet development. Further, the dry developer is classified into two types. One of them is the magnetic toner wherein the magnetic particles are added internally or externally to the binder resin for the single component or two component developer. Other is the non-magnetic toner wherein the magnetic particles are not added.

In the magnetic single component development, the electrostatic latent image is developed by a thin toner layer which is formed on the developer retaining member wherein fixed magnets are incorporated inside. Here, particularly, the magnetic single component jumping development using the insulating magnetic toner is more widely employed, although the conductive toner is also used in the above-mentioned conventional magnetic single component development.

Further, particularly, in the magnetic single component jumping development, the insulating magnetic toners are electrically charged by the friction caused in such a manner that the insulating magnetic toners pass though the gap between the ear cutting blade for regulating the thickness of the toner layer and the rotating developer retaining member which incorporates the fixed magnets. The charged toner layer is retained on the rotating developer retaining member by the magnetic force of the fixed magnets.

The toners in the toner layer are jumped over the gap between the latent image retaining member and the developer retaining member, thereby developing the latent image by applying a DC voltage or an AC voltage superposed DC voltage.

The single component jumping development can be executed by the insulating magnetic toner, but not by the conductive magnetic toner.

The insulating magnetic toner has an advantage that it is easily charged by he friction and it can jump to the latent image, without contacting the latent image before jumping, thereby avoiding the background fog.

Recently, the image forming process speed becomes farther higher and the image forming apparatus is made farther smaller-sized. Particularly, the high-speed apparatus for the business use should prevent the degradation of image resolution and quality. Accordingly, it is required to more rapidly rise up the electric charge quantity of the magnetic toner and moreover to stabilize the electric charge quantity.

On the other hand, the smaller-sized middle and low speed apparatus for the small office and family use should farther shorten the warming-up time after switching on the apparatus, because the electric power supply is very often switched on and off. Accordingly, it is required to well and rapidly charge the magnetic toner when the power supply is switched on. Further, regardless of the image forming speed, it is required to farther improve the image quality & resolution and the endurance & environmental stability of the magnetic toner.

Accordingly, the magnetic toner is required to be rapidly charged up, without insufficiently nor excessively charging up under the high temperature high humidity environment or the low temperature and low humidity environment, thereby maintaining the proper charger quantity for a long term and thereby obtaining excellent image quality (image density, background fog and so on).

However, the conventional magnetic toners generally used are not satisfactory in the current tendency seeking higher process speed and smaller-sized apparatus. The main reason lies in the magnetic particle contained in the magnetic toner.

The magnetic particle is, in general, a sphere or a polyhedron such as a cube, a hexahedron or an octahedron.

Such a magnetic toner is likely to leak the electric charge, because the electric charge is easily leaked from the vertexes and edges of the polyhedron. Further, the magnetic polyhedrons do not well disperse, thereby fluctuating the charging characteristics.

Accordingly, the polyhedron magnetic toner has a disadvantage that the charge quantity does not rapidly rise up, resulting in a low charge quantity, the toner scattering & dropping and the image quality degradation such as the fogging in the image background. Further, it has another disadvantage that the image quality is farther degraded in the high temperature and high humidity environment where the electric charging becomes difficult.

On the contrary, the spherical magnetic particle has an advantage that the charge leak is not easily induced, because it does not have any vertex nor edge line. Accordingly, the electric charges are not easily discharged. Further, it has another advantage that it disperses well in the binder resin more than the polyhedron particle, thereby preventing the fluctuations in the dispersion, the easiness of the electric charging and the charge quantity.

However, the spherical magnetic particle is easily charged so much that the excessive charge-up is easily caused and the image quality degradation such as the low image density is easily induced.

Therefore, the various shaped magnetic particles are studied, in order to take in the shape merits of both of the sphere and the polyhedron.

For example, there are disclosed in JP11-153882A (1999), JP2000-162817A and JP2000-242029A that the vertexes and edges of polyhedron are trimmed by surfaces smaller than the original polyhedron surfaces. However, pointed lines are still left, thereby easily discharging from the pointed lines and therefore thereby possibly causing the low image density and the background fog.

Further JP9-59024A (1997) discloses that the edgelines of the polygon are rounded. However, it has a disadvantage that the magnetic toner is charged up similarly to the spherical magnetic toner, thereby possibly causing the image quality degradation.

Further, JP11-288125A(1999) discloses that the styrene monomer of dissolution temperature 35° C. through 80° C. improves the image transfer efficiency, although the fixing capability, the image smearing and the long term endurance of the toner are apt to degrade. The well-known reason is that the spherical particles are well buried into the toner.

The conventional toners has several disadvantages. First, the conventional toner wherein the magnetic powders are added in the inside of the toner has a disadvantage that it is not rapidly charged, is excessively charged up and is unstable against the environmental condition. Second, it has another disadvantage that the internal portion of the solid image is not well transferred, if the toner sphericity is too low (i.e., far from the sphere), while the photoreceptor drum is not well cleaned due to the slipping of the toners through the cleaning blade, if the toner sphericity is too high (i.e., almost like sphere shaped). Here, the sphericity is defined by C2/C1, where C1 is a circumferential length of an image projected on a plane and C2 is a circumferential length of an assumed circle of which area is equal to that of the projected image. Third, if the toner content of smaller than 2 μm is abundant, the toner charge distribution becomes broad, thereby resulting in the degrading of the background fog, the photoreceptor cleaning and the long term endurance. Particularly, the toners are easily attached to the developing roller and the photoreceptor, thereby degrading the above-mentioned image transfer capability and the long-term stability.

Accordingly, the toner should be optimized in the magnetic particle shape, toner sphericity and the toner size, in order to obtain the high image resolution, high image quality and the high environmental stability.

SUMMARY OF THE INVENTION

An object of the present invention is to provide a magnetic toner which can be rapidly charged and moreover improve the contradictory characteristics of obtaining the sufficient electric charge quantity and suppressing the over charge. Another object of the present invention is to form an excellent image under various environmental conditions. Other object of the present invention is to suppress the photoreceptor contamination as hardly as possible. Still another object of the present invention is to provide a magnetic toner which can endure various high stress uses.

First, the toner of the present invention internally contains magnetic particles and develops an electrostatic latent image. In the toner, said magnetic particle is of average particle size 0.01 μm through 0.50 μm, is of octahedron shape that is a convex polyhedron surrounded by eight triangles as a basis, each of vertexes and edges of the octahedron being in a curved surface shape and having a portion that can be taken as a straight line on the outer periphery of a projected image of the octahedron, the sphericity of said magnetic toner is 0.94 through 0.98. Further, the number content of said toner of particle size 0.6 μm through 2.0 μm is smaller than 10%.

Second, the content of said magnetic particle in said magnetic toner is 35 wt. % through 60 wt. %.

Third, the magnetic toner includes a first shape of said magnetic particle is of octahedron shape that is a convex polyhedron surrounded by eight triangles as a basis, each of vertexes and edges of the octahedron being in a curved surface shape and having a portion that can be taken as a straight line on the outer periphery of a projected image of the octahedron, and a second shape of said magnetic particle is of not-tapered hexahedron or not-tapered octahedron, or tapered hexhedron or tapered octahedron wherein edges are tapered. Those magnetic particles of said first and second shape are mixed in said magnetic toner. Further, the magnetization of said magnetic toner is equal to or greater than 2.0 $Am^2/kg$ and smaller than 9.0 $Am^2./kg$ at a magnetic field 79.6 kA/m.

Fourth, the electro-photographic image forming method of the present invention uses the above-mentioned toner. The image forming method comprises the $1^{st}$ step of retaining magnetic toners on a rotating toner retaining member wherein magnets are fixed, $2^{nd}$ step of said developer retaining member, at a gap, against a latent image retaining member which is an a-silicon photoreceptor; and $3^{rd}$ step of flying said magnetic toners toward said latent image retaining member, thereby developing said latent image.

According to the present invention, the toner which is of the high resolution, high image quality, is highly endurable and is strong against the environmental change, can be provided. Further, the imaging apparatus using the toner of the present invention is provided.

Concretely, according to the present invention, due to the novel shape of the magnetic particle, the electric charges of the magnetic toner rise up rapidly, the excessive charging is suppressed and the stability under the environmental change is improved. Further, due to the consideration of the sphericity and the fine particle content, the high endurance and high image quality are guaranteed. Furthermore, The externally added particle such as the charge control agents are made relatively large, thereby preventing the externally added particles from burying into the surface of the toner, thereby guaranteeing the endurance.

BRIEF DESCRIPTION OF THE DRAWINGS

FIG. 5 is a table of examples and references of carrier-less single component magnetic developers, regarding the particle size, magnetic particle content and the magnetic particle shape.

FIG. 6 is a table of examples and references of image quality under 20° C./65 RH %, regarding the image density, the image defect, line reproductivity and the charge quantity.

FIG. 7 is a table of examples and references of image quality under 10° C./20 RH %, regarding the image density, the image defect, line reproductivity and the charge quantity.

FIG. 8 is a table of examples and references of image quality under 33° C./85 RH %, regarding the image density, the image defect, line reproductivity and the charge quantity.

DETAILED DESCRIPTION OF THE PREFERRED EMBODIMENTS

Figure 1:
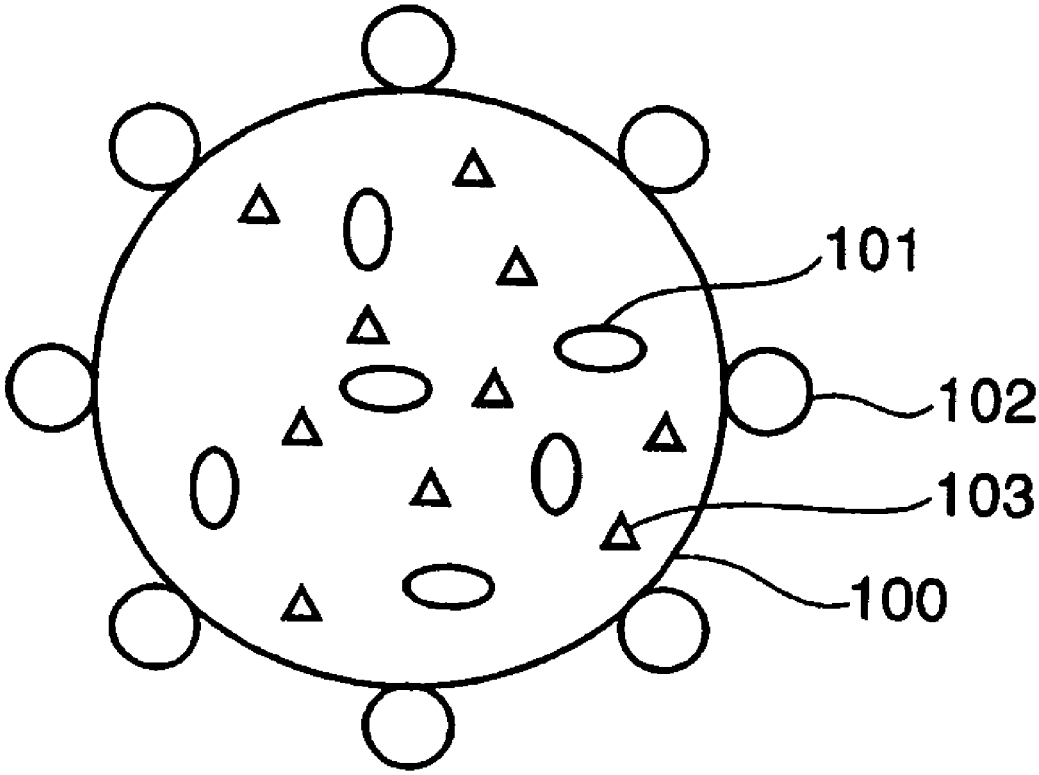
FIG. 1 is a schematic view of the toner of the present invention.

The preferred embodiments of the present invention are explained, referring to the drawings. It should be understood that the present invention is not limited to specifically described sizes, materials and relative arrangements and so on regarding the constituent components.

Figure 2:
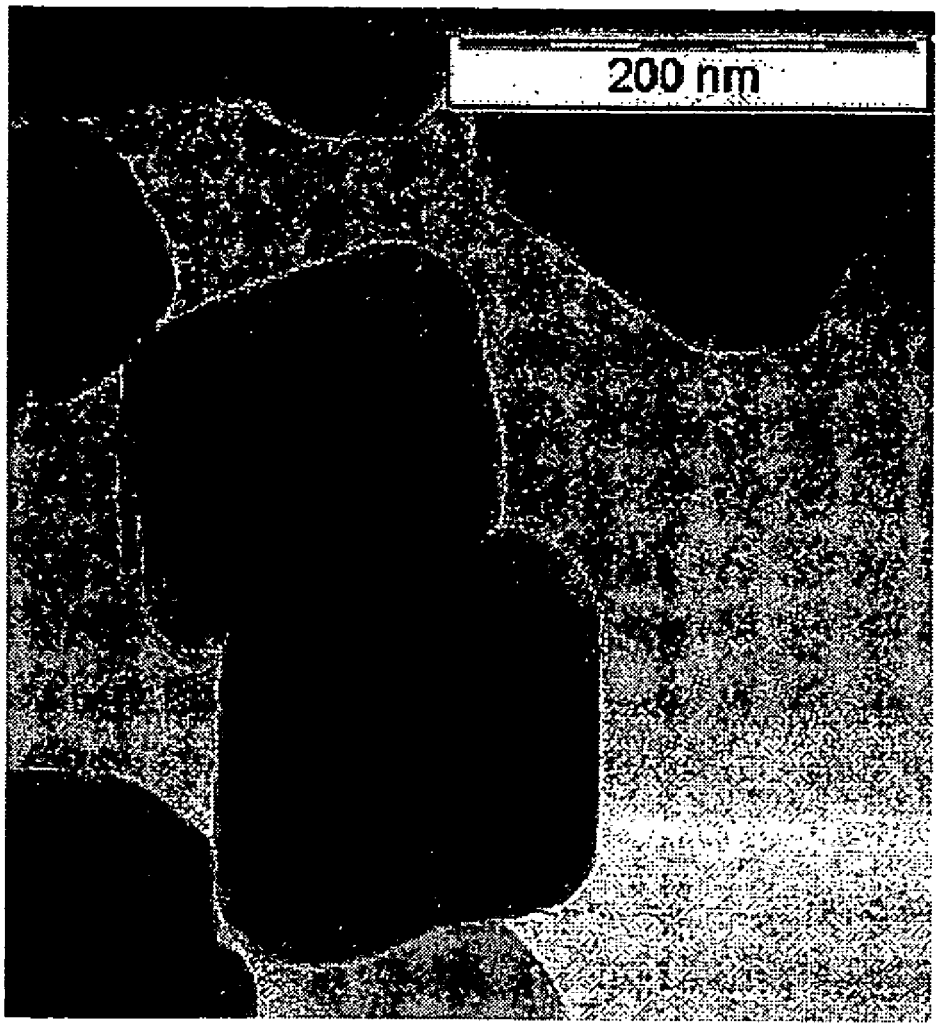
FIG. 2 is a TEM photograph of the magnetic particle contained in the toner of the present invention.

First, the magnetic particle contained in the toner of the present invention is explained, referring to FIG. 1 and FIG. 2.

Magnetic Particle

FIG. 1 is a schematic view of the toner of the present invention.

There are added in the toner 100 magnetic particles 101 and other particles 103. The magnetic particle 101 is of average size 0.01 μm through 0.50 μm and is of convex octahedron having eight triangle surfaces. Moreover, its vertexes and edges are not pointed but rounded. The projected image of the magnetic particle has linear portions at its outer circumference. The magnetic particle 101 is of magnetite including at least one element of 0.1 at. % through 10 at. % for Fe selected from Mn, Zn, Ni, CU, Al, Ti and Si. Further, 35 wt. % through 60 wt. % of the magnetic particles 101 are added in the toner particle 100. Alternatively, the magnetic particles of pointed octahedron, pointed hexahedron, tapered octahedron and pointed octahedron are mixed in a toner, thereby obtaining the toner wherein its magnetization is 2.0 $Am^2/kg$ through 9.0 $Am^2/kg$ at the magnetic field 79.6 kA/m, its sphericity is 0.94 through 0.98, particle size is 0.6 μm through 2.0 μm and the number content of the toner equal to or greater than 0.6 μm and smaller than 2.0 μm is smaller than 10%. Here, the sphericity is defined by C2/C1, where C1 is a circumferential length of an image projected on a plane and C2 is a circumferential length of an assumed circle of which area is equal to that of the projected image. The particle size of the toner 100 is preferably 5.0 μm through 10.0 μm.

If it is smaller than the lower limit, its fluidity is lowered. On the other hand, if it is greater than the upper limit, the image quality is degraded. The magnetic particles 101 are mixed with the other particles 103 such as the charge control agent, coloring agent and wax. They are fused and kneaded. Further, the kneaded mixture is coarsely ground first and then finely ground. They are classified, thereby obtaining a prescribed shape and a prescribed distribution. Further, another particles 102, added at the toner surface, for controlling the fluidity, the endurance, the cleaning capability, the environmental stability and so on are selected from at least one in the group of silica, alumina, titanium oxide, aminosilane, silicone oil, silane coupling agent, titanium coupling agent. The another particles 102 are dusted on the toner surface by Henschel mixer or Nauter mixier.

FIG. 2 is a TEM photograph of the magnetic particles 101.

The magnetic particle 101 is characterized in that its vertexes and edges of the fundamental octahedron and therefore there is not a pointed vertexes and edges from which the electric charges are emitted. However, it is not close to the sphere wherein the radius of curvature is great enough to connect the adjacent vertexes and edges and there is not a portion deemed to be linear. As shown in FIG. 2, the linear portion is left at the outer circumference of the projected image and the feature of the octahedron is left.

The particle size of the toner 100 is preferably 4 μm through 12 μm and more particularly 5 μm through 10 μm. In order to produce the toner particle of average sphericity greater than 0.94, the above-mentioned components are fused, kneaded, coarsely ground, finely ground and classified. The fine grinding pressure is made higher than the ordinary pressure of the jet mill, by using the TURBOMILL (product name of TURBOMILL KOUGYOU Co.Ltd.), the FINEMILL (product name of NIPPON PNEUMATIC MFG. Co.Ltd.), the INOMIZER (product name of HOSOKAWA MICRON Co.Ltd.), the SUPERROTER (product name of NOHON ENGINEERING Co.Ltd), the SEBUROSU (product name of KAWASAKI HEAVY INDUSTRIES Co.Ltd.). In order to produce the toner particle of average sphericity greater than 0.94, the grinding process is executed for a longer time, or repeated several times. Further, a mixing process after the grinding process may be executed for a prescribed time interval by using a high speed stirring type mixer such as the HESCHEL mixer of MITSUI MINING Co. Ltd. Further, in order to have a prescribed particle size, classification processes more than two times may be executed after the grinding process. The classification apparatus may be of air flow type, rotating rotor type, or conventional toner particle classification apparatus.

The average particle size (particle diameter) of the magnetic particle should be between 0.01 μm and 0.50 μm. If it is smaller than 0.01 μm, the magnetic particles exposing from the toner surface are increased from which the electric charges are emitted, thereby causing poor charging and therefore causing the image density decrease. On the contrary, if it is greater than 0.50 μm, the electric charges are not properly discharged, thereby causing the charge-up and therefore causing the image density decrease after making a quite lot of copies. The average particle size is preferably between 0.05 μm and 0.35 μm, and is more preferably between 0.15 μm and 0.30 μm. Here, the average particle size is determined, for example, by the Martin diameters of, e.g., 300 particles, by using the TEM photograph enlarged by, e.g., four times. The magnetic particle may be of ferromagnetic material such as Fe, Co and Ni and their alloys, compounds with the elements, nonmagnetic material alloys which are made ferromagnetic by a heat treatment, or compounds such as $CrO_2$ which does not contain any ferromagnetic material. Particularly, the ferrite or magnetite is preferable.

Next, the manufacturing of the magnetic particle 101 is explained.

Manufacturing of Magnetic Particle

First, 26.7 liter iron (II) sulfate salt aqueous solution containing 1.5 mol/liter $Fe^{2+}$ is added to 25.9 liter aqueous solution of 3.4 N sodium hydrate (1.10 equivalent weight per $Fe^{2+}$). The mixed solution is heated at 90° C. and maintained at pH 10.5, thereby making iron (II) sulfate salt suspension containing iron (II) hydrate colloid. Second, 100 liter/minute air is blown into the 90° C. suspension for 80 minutes maintaining pH10.5, thereby causing the oxidization reaction up to 60% reaction rate of iron (II) salt. Third, sulfuric acid aqueous solution is added to the suspension, thereby making the pH of the suspension 6.5. Then, 100 liter/minute air is blown into the 90° C. suspension for 50 minutes, thereby generating the magnetite particles in the suspension. Forth, sodium hydrate aqueous solution is added to the suspension containing the magnetite particles, thereby making the suspension pH10.5. Then, 100 liter/minute air is blown into the 90° C. suspension for 20 minutes. Then, the generated magnetite particles are washed by water by a conventional method, thereby generating the magnetite particle in the suspension. Then, they are filtered, dried and pulverized. Thus, the magnetite powder of the trimmed octahedral shape is obtained. In general, the magnetite manufacturing may comprise a metal addition process and a pH control process. Various aqueous metal compounds such as silicic acid may be added to hydrate alkaline aqueous solution or aqueous solution containing iron (II) hydrate colloid, in such a manner that 0.1 at. % through 10 at. % of the various metals are added for Fe. Further, in the pH control process in the metal addition process, the pH of the aqueous solution may be preferably maintained at pH 8.0 through 9.5, when the gas containing oxygen is blown in. The generated magnetic powder contains the magnetite which includes the above-mentioned prescribed contents of Fe and other metals of about 0.1 at. % through 10 at. % of at least one materials selected from Mn, Zn, Ni, Cu, Al, Ti and Si. Further, the radius of curvature around the vertexes and the edgelines is controlled by the reaction rate in the above-mentioned oxidization reaction rate. Further, the magnetic particle 101 is preferably of 1.0 wt.part through 35 wt.part and more preferably is 20 wt.part through 25 part. %, for 100 wt.part resin. If the content of the magnetic particle 101 is lower than the lower limit, the magnets in the developing means cannot well hold the magnetic particles 101, thereby possibly causing the image background fogging and the toner scattering. On the other hand, if the content of the magnetic particle 101 is higher than the higher limit, the magnet fixed in the developing means excessively hold the magnetic toners 100, thereby possibly causing the image density decrease. Further, the toner 100 is not well fixed onto the paper surface, because the content of the binder resin is lowered, compared with the magnetic particle.

In order to improve the dispersion of the magnetic particles 101 into the binder resin, the surface of the magnetic particle 101 may be treated by the titanium coupling agent, silane coupling agent, aluminum coupling agent or fatty acid surface treatment agent, taking into consideration its dispersion into the binder resin.

Particularly, preferably used silane coupling agents are:

hexamethyldisilazane, trimethylsilane, trimethylchlorsilane, trimethylethoxysilane, dimethyldichlorsilane, metyltrichlorsilane, allyldimethylchrolsilane, allylphenildichrolsilane, benzildimethylchrolsilane, brommethyldimetylchrolsilane, α-chrolethyltrichrolsilane, β-chrolethyltrichrolsilane, chrolmethyldimethylchrolsilane, triorganosilanizingmercaptan, trimethylsilinizingmethylcaptan, triorganosilinizingacrylate, vinyldimethylacetokyxisilane, dimethyldiethoxisilane, dimethyldimetoxisilane, diphenylethoxisilane, hexamethyldisiloxane, 1,3-divinyltetramethylsiloxane, and 1,3-diphenyltetramethyldisiloxane.

Further, preferably is used dimethylpolysiloxane which includes 2 through 12 unit siloxane and moreover one hydrate base connected with siloxane element in the siloxane unit positioned at the ends.

Next, the binder resin for the toner particle 100 is explained.

Binder Resin

Binder resin may be a single polymer of polyethylene, styrene, or copolymer of styrene and other monomer.

The preferable other monomer are:

p-chlora styrene; vinylnapthalene; ethyleneunsatulatedmonoorefine such as ethylene, propylene, butylane or isobutylene; vinyl halide such as vinylchroride, vinylbromide, or vinyl fluoride; vinyl ester such as vinylacetate, vinylpropionacid, vinylbenzoeacid, vinylbutyric acid; (meta)acrylic acid ester such as acrylicacidmethyl, acrylicacidethyl, acrylicacidn-butyl, acrylicisobutyl, acrylicaciddotesyl, acrylicacidn-octyl, acrylicacid2-chloraethyl, acrylicacid phenyl, α-chloraacrlicacidmethyl, metaacrylicacidmethyl, mataacrylicacidethyl, or metaacrylicacidbutyl; other metaacrylic derivative such as acrylonitryl, metaacrylnitryl, acrylamid; vinylether such as vinylmethylether, or vinylisobutylether; vyiylketone such as vinylmethylketone, vinylethylketone, or methylsopropynylketone; N-vinylcompound such as N-vinylpyrora, N-vinylcarbazole, N-vinylindole, or N-vinypyrroriden. One of them is used alone, more than two of them are co-polymerized with the styrene monomer.

As well as the polystyrene, the polyester resin of the polycondensation compound ortho-polycondensation compound of alcohol and carboxylic acid is usable.

The examples of dihydric or trihydric alcohol component are:

diol such as ethylenegrycole, diethylenegrycole, triethylene grycole, 1,2-propylenegricole, 1,3-propyrenegricole, 1,4-butanediol, neopentylgrocole, 1,4-butenediol, 1,5-pentanediol, 1,6-hexane diol, 1,4cyclohexanedimethanol, dipropyrenegricole, polyethylenegricole, polypropyrenegricole, polytetramethylenegrycole;

bisphenol such as bisphenol A, hydrogen added bisphenol A, polyoxyethylenebisphenol A, or polyoxypropylenebisphenol A; or trihydric alcohol such as sorbitol, 1,2,3,6-hexanetetorora, 1,4-sorbitane, pentaerythril, dipentaerythritol, tripentaerythritol, 1,2,4-butanetriol, 1,2,5-pentatoriol, grycelora, digrycelora, 2-methylpropanetriol, 2-methyl-1, 2,4-butanetriol, trimthylolaethene, trimethylorapropane, or 1,3,5-trihydroximethylbenzene.

The preferable dihydric or trihydric carboxylic acid component is dihydric, trihydrate, or multiplehydrate carboxylic acid, or its anhydride or its lower alkylester.

The preferable components are:

dihydric carboxylic acid of alkyl (such as maleic acid, fumaric acid, citracon acid, itacon acid, glutaconic acid, futal acid, isofutal acid, telefutaric acid, telefutalic acid, cyclohexanedicarboxylic acid, succinic acid, adipic acid, sebatine acid, azelaic acid, malonic acid, n-butylsuccinic acid, n-butenylsuccinic acid, isobutylsuccinic acid, isobutenylsuccinic acid, n-octylsuccinic acid, n-octenylsuccinic acid, n-dodethylsuccinic acid, n-dodethenylsuccinic acid, isododethylsuccinic acid, isododethynylsuccinic acid), or dihydric carboxylic acid such as alkenylsuccinic acid; and trihydrate or multiplehydrate carbone acid such as 1,2,4-benzenetricarbonacid (trimeritacid), 1,2,5-benzenetricarboxylic acid, 2,5,7-nafthalenetricarboxylic acid, 1,2,4-nafthalenetricarboxylic acid, 1,2, 4-butanetricarboxylic acid, 1,2,5-hexanetricarboxylic acid, 1,3-dicarbokyl-2-methyl-2-methylenecarbokyipropane, 1,2,4-cychlohexanetricarboxylic acid, tetra (methylenecarboxyil) methane, 1,2,7,8-octanetetracarbone acid, pyromeritacid, or enpoltrimereacid.

The softening temperature of the polyester resin is preferably 110° C. through 150° C. and more preferably 120° C. through 140° C.

Further, the binder resin may be thermosetting resin. The introduction of the bridging structure improves preservation stability, shape sustaining and endurance of the toner 100, without lowering the fixing capability. The thermosetting resin is not necessarily used alone, but the toner particle 100 may be added by the bridging agent, or thermosetting agent. The preferable thermosetting resin is epoxy resin or cyanate resin such as bisphenol A type epoxyresin, hydratedbisphenol A type epoxy resin, novolac type epoxy resin, polyalkyleneether type epoxy resin, cyclic fatty acid epoxy resin, cyanate resin, or combinations of one or more of them.

In the above-explained various binder resins, the glass transision temperature Tg of the binder is preferably 50° C. through 65° C. and more preferably 50° C. through 60° C. If it is lower than the lower limit, the preservation stability is lowered, resulting in that the toner particles 100 are fused in the developing chamber. Further, toner particles 100 are apt to attach the photoreceptor, because the resin strength is weak. On the contrary, if it is higher than the higher limit, the low temperature fixing characteristics are lost.

The glass transition point is, for example, a point at which the specific heat is changed in an endotherm curve measured by the differential scanning calorimeter (DSC). Concretely, the endotherm curve of 10 mg sample in an aluminum pan is measured by the DSC-6200 of Seiko Instruments Co. Ltd., under the conditions of the temperature ascend rate 10° C./min in the temperature range of 25° C. through 200° C. The reference is an empty aluminum pan.

Next, the electric charge control agent is explained.

Charge Control Agent

The charge control agent improves the electrical charging level and the rapidity of the electrically charging, thereby obtaining the endurance and the stability of the charging. One of the preferable positive electric charge control agents is an organic compound having a basic nitrogen atom such as basic dye, aminopyrine, pyrimizine compound, multiple nucleus polyamino compound, aminosilane, or filler coated by the above-mentioned compounds. On the other hand, the preferable negative electric charge control agents are negrosine base (C15045), oil black (C126150), pontron S, oil soluble dye such as spironblack, charger controlling resin such as coplymer of styrene and sulfonic acid, compound having carboxi base such as acetylacetonemetal chilate, metal complex dye, fatty acid metal soap, resin acid soap and naftaneacid metal salt.

The content of the positive or negative electric charge control agent for 100 weight part binder is 0.1 wt.part through 10 wt.part and more preferably 0.5 wt.part through 8 wt.part.

The concrete examples of the positive charge control agents are:

azine compounds such as pryidazine, pryimidine, pyrazine, orthooxyazine, metaoxyazine, paraoxyazine, orthothiazine, metathiazine, parathyiazine, 1,2,3-triazine, 1,2,4-triazine, 1,3,5-triazine, 1,2,4-oxyadiazine, 1,3,4-oxyadiazine, 1,2,6-oxyadiazine, 1,3,4-thiadiazine, 1,3,5-thiadiazine, 1,2,3,4-tetrazine, 1,2,4,5-tetrazine, 1,2,3,5-tetrazine, 1,2,4,6-oxyatriazine, 1,3,4,5-oxyatriazine, phthalazine, quinazoline, quinoxyalin; direct dyes comprising the azine compounds such as azine fast red FC, azine fast red 12BK, azine violet BO, azine brown 3G, azine light blue GR, azine dark green BH/C, azine deep black EW and azine deep black 3RL; nigrocine compounds such as nigrocine, nigrocine salt, nigrocine derivative; acid dye comprising the nigrocine compound such as nigrocine BK, nigrocine NB, nigrocine Z; metal salt of naftane acid or higher fatty acid; acloxylatedamin; alkylamid; benzilmethylhexyldecylammonium; class $4^{th}$ ammonium salt of benzilmethylhexyldecylammonium, decyltrimethylammoniumchloride.

They are used alone, or more than two of them are mixed and used.

Particularly, the negrocine is preferable for the positive toner 100, because the electric charges rise up rapidly.

Further, the positive charge control agent can also be selected among resins and oligomer having functional group of class $4^{th}$ ammonium salt, carboxylic acid salt, or carboxyl base.

More concretely, styrene resin having class $4^{th}$ ammonium salt, acrylic resin having class $4^{th}$ ammonium salt, styrene-acrylic resin having class $4^{th}$ ammonium salt, polyester resin having class $4^{th}$ ammonium salt, strylene resin having carboxylic acid salt, acrylic resin having carboxylic acid salt, strylene-acrylic resin having carboxylic acid salt, polyester resin having carboxylic acid salt, polystryrene resin having carboxylbase, acrylic resin having carboxylbase, styrene-acrylic resin having carboxylbase and polyestel resin having carboxyl base.

Particularly, the styrene-acryle copolymer resin having class $4^{th}$ ammonium salt is most suitable, because the electric charges are easily controlled at the prescribed level.

The preferable acryl co-monomers for the above-mentioned stryrene are:

acrylicacidmethyl, acrylicacidethyl, acrylicacidn-propyl, acrylicacidiso-propyl, acrylicacidn-butyl, acrylicacidiso-butyl, acrylicacid2-ethylhexile, metaacrylicacidmethyl, metaacrylic acid ethyl, metaacrylic acidn-butyl, and (meta) acrylicacidalkylester of metaacrylicacidiso-butyl and so on.

Further, the class $4^{th}$ ammonium salt is derived from class $4^{th}$ forming process of the dialkylaminoalkyl(meta)acrylate.

The derived dialkylaminoalkyl(meta)acrylates are, for example: di(lower alkyl)aminethyl(meta)acrylate such as dimethylaminoethyl(meta)acrylate, diethylaminoethyl (meta)acrylate, dipropylaminoethyl(meta)acrylate, dibutylaminoethyl(meta)acrylate; dimethylmetacrylamid; and dimethylaminopropylmetaacrylamid.

Further, there are following polymerization monomers used jointly with the above-mentioned monomers. They are hydroxyethyl(meta)acrylate, hydroxypropyl(meta)acrylate, 2-hydroxybutyl(meta)acrylate, N-methlora(meta)acrylamid.

The negative charge control agents are, for example:

organic metal chilate, chilate compound, aluminumacetylaceton, iron(II)acetylaceton, 3,5-di-tert-butylsalicylicacid chromium.

Particularly, the acetylaceton metal complex, the complex or salt of the saslicylicacid metal are preferable and more preferable are the complex or salt of the saslicylicacid metal.

The content of the positive or negative charge control agent for 100 wt.part (toner particle as a whole is 100 wt. part) is preferably 0.5 wt.part through 15 wt.part, more preferably 0.5 wt.part through 8.0 wt.part and most preferably 0.5 wt.part through 7 wt.part. If it is lower than the lower limit, the charging is not stable, thereby lowering the image density and endurance, inducing insufficient dispersion of the charge control agent and contaminating the photoreceptor. On the other hand, if it is higher than the higher limit, the insufficent charging, image quality degradation and the photoreceptor contamination are induced.

Next, the offset preventing agent for preventing the toners 100 from attaching to the toner fixing unit.

Offset Preventing Agent

The offset preventing agents are ariphatic hydrocarbon, ariphatic metal salt, higherfattyacid, fattyacidester or its saponification, silicone oil and various waxes. Among them are preferable the ariphatic fatty hydrocarbon of weight average molecular weight 1,000 through 10,000 such as low molecular weight polypropylene, low molecular weight polyethylene, paraffin wax, low molecular weight polyorefin wax comprising orefin units having 4 or more carbon atoms, and combination of one or more kinds of silicone oils. The content of the offset preventing agent for 100 wt.part binder resin is preferably 0.1 wt.part through 10 wt.part, more preferably 0.5 wt.part through 8 wt.part. Further, various additives such as stabilizer and so on are added to the offset preventing agent.

Next, the waxes for improving the fixing capability and preventing the offset are further explained in detail.

Wax

The preferable waxes are polyethylene wax, polypropylene wax, Teflon(trade mark) wax, Fischer-Tropsch wax, paraffin wax, ester wax, montan wax, lice wax. Two or more of them may be employed. The offset and image smearing are effectively prevented by those waxes. The content of the wax for 100 wt.part toner as a whole is preferably 1 wt.part through 5 wt.part. If it is lower than the lower limit, the offset and image smearing may not be effectively prevented. On the other hand, if it is higher than the higher limit, the toners 100 may easily fused in the developing chamber, i.e., the preservation stability is lowered.

Next, the coloring agents are explained.

Coloring Agent

The coloring agents are, for example, dyes for black, magenta, cyan and yellow. Those contents of the coloring agents for 100 wt.part binder is preferably 1 wt.part through 20 wt.part and more preferably 3 wt.part through 15 wt.part.

In the following, the coloring agent for each color is explained.

The black coloring agents are magnetite, ferrite, carbon black, acetyl black, lamp black and aniline black.

The magenta coloring agents are those described in the color index such as C.I. pigment red 81, C.I. pigment red 122, C.I. pigment red 57, C.I. pigment red 49, C.I. solvent red 49, C.I. solvent red 19, C.I. solvent red 52, C.I. basic red 10, C.I. disperse red 15, and other red pigments such as red iron oxide, cadminium red, red lead, mercurysulfidedcadminium, permanent red 4R, risol red, birazolon red, watching redcalcium salt, lakered D, brilliant carmine 6B, eosinelake, rhodaminelake B, alizarinlake, brilliant carmine 3B.

Cyan coloring agents are those described in the color index such as C.I. pigment blue15, C.I. pigment blue15-1, C.I. pigment blue 16, C.I. solvent blue 55, C.I. solvent blue 70, C.I. direct blue 86, C.I. direct blue 25. The violet pigments are manganeseviolet, fast violet B, methyl violet B. The blue pigments are Prussian blue, cobalt blue, alkali blue lake, Victoria blue lake, phthalocyanine blue, metalfree phthalocyanine blue, partially chlorinated phthalocyanine blue, first skyblue and induslene blue BC.

The yellow coloring agents are nitropigments such as naphtholellow S, azopigments or yellowironoxide such as hanzayellow 5G, hanzayellow 3G, hanzyellow G, benzidineyellow G, balkanfast yellow 5G, inorganic pigments such as yellow lead, zinc yellow, cadmium yellow, yellow ironoxide, mineralfast yellow, nickeltitanium, naples yellow, naphthol yellow S, hanza yellow 10G, benzidine yellow G, benzidine yellow GR, quinoline yellow lake, permanent yellow NCG, tartoradine lake, yellow ocher, those described in the color index such as C.I. pigment yellow 12, C.I. pigment yellow 180, C.I. solvent yellow 2, C.I. solvent yellow 6, C.I. solvent yellow 14, C.I. solvent yellow 15, C.I. solvent yellow 16, C.I. solvent yellow 19, C.I. solvent yellow 21.

The orange pigments are redmouse yellow lead, morybudenum orange, permanent orange GTR, pyrazolone orange, Balkan orange, indusrene brilliant orange GK.

The green pigments are chromium green, chromium oxide, pigment green B, malachite green lake, final yellow green G.

Next, the externally added particle 102 is explained.

Externally Added Particle

The externally added particle 102 maintains the fluidity, the preservation stability and cleaning capability of the toner particle 101. The preferable externally added particles 102 are colloidal silica, hydrophobic silica, titanium oxide, alumina and silicon carbide (usually of average particle size smaller than 1.0 μm). The externally added particles 102 are preferably mixed with the toner particles 100, in a dry atmosphere, by henschel mixer, or Nauter mixer, in order to prevent the externally added particles from being buried into surface of the toner particle 100. The content of the externally added particle is preferably 0.2 wt. % through 10.0 wt. %. Further, the surface of the externally added particle 102 may be treated, if necessary, by aminosilane, silicone oil, silane coupling agent (such as hexamethydisilazane), titanium coupling agent.

The above-explained toner 100 together with the externally added particle 102 forms a carrier-less single component developer.

As well as the single component magnetic toner 100, the single component toner 100 can also be used in a two component developer comprising the above-explained magnetic toner 100 and a magnetic carrier.

Two Component Developer

The above-explained toner 100 together with the magnetic carrier forms a two component developer. Here, the magnetic carrier is of saturation magnetization about 70 emu/g and $10^6$ Ωcm through $10^9$ Ωcm. The magnetic toner particles 100 are separated, at the nip between the developing roller and the magnetic roller (as explained later), from the magnetic brush (magnetic ears) formed by the magnetic toners 100 and the magnetic carriers. In order to increase the contact points with the toner particles 100, the surface area is preferably increased, by making the volume average particle size 20 μm through 150 μm, preferably 20 μm through 100 μm and more preferably smaller than 40 μm (about 35 μm). If the carrier resistance is lower than $10^6$ Ωcm, it is difficult to maintain the development without the induction of the fog, and the toner particles 100 are scattered from the developing roller surface, thereby contaminating the charging unit and the exposing unit, although the easily recovered low resistant carrier is effective against the developing ghost. If the carrier resistance is higher than $10^9$ Ωcm, the toner 100 is excessively charged. Therefore, the carrier resistance should be proper, in order to recover the toner 100 on the developing roller, thereby supplying again the developing roller with the recovered and well charged toner particles 100. The charge of the toner 100 is controlled between 5 μC/g through 20 μC/g, thereby preventing the scattering and fog of the toner particles 100, leaving no development hysteresis on the development roller because of the low electric field, and easily recovering the toner particles 100 from the developing roller.

The nucleus particle of the carrier may be of conventional ferromagnetic material such as Fe, Co and Ni; compound such as magnetite, hematite and ferrite; and mixture of resin and the ferromagnetic fine particle. Materials of high corrosive and low resistant carriers are, for example, magnetite, Mn-ferrite and Mn-Mg ferrite. Further, the carrier particle is preferably coated by resin, in order to improve the endurance.

The preferable coating resins are:

polyethylene, polypropylene, chlorinatedpolyethylene, polyolefine resin such as chlorosulfonatedpolyethylene, polystyrene, acryl such as polymethylmethacrylate, polyacrylnitryl, polyvynylacetate, polyvinyl alcohol, polyvinylbutylar, polyvinylchloride, polyvinylcarbazole, polyvinyether, polyvinyl such as polybiliketone and polyvinylidene resin; vinyl chloride-vinyl acetate copolymer; silicone resin having organosiloxane bond or its denaturation of alkyd resin, polyester resin, epoxy resin, and polyurethane resin; fluoride resin such as polytetrafluoroethylene, polyfluoridevinyl, polyfluoridevinylidene, polychlorotrifluoroethylene; polyamide; polyester; polyurethane; polycarbonate; amino resin such as urea-formaldehyde; and epoxy resin.

Further, there may be dispersed in the carrier the conventional electric conductive material such as metals, e.g., iron, gold, or copper; iron oxide such as ferrite and magnetite; and carbon black. Particularly, a small amount of mixture of furnace black and acetylene black facilitates to control effectively the carrier conductivity, whereby the coating layer becomes highly abrasion-resistant. Those conductive fine particles are preferably of 0.01 μm through 10 μm. Their content for 100 wt.part resin is preferably 2 wt.part through 30 wt.part and more preferably 5 wt.part through 20 wt.part. Further, there may be added, in the carrier coating layer, the silane coupling agent or the titanium coupling agent, in order to improve the adhesivity to the nucleous particle such as Fe and to improve the dispersion capability of the conductive material. The coating layer is made by a conventional method whereby the coating liquid is coated on the surface of the carrier nucleus particles by the atomization or the dipping. The coating layer thickness is preferably 0.1 μm through 20 μm and more preferably 0.2 μm through 5 μm. The toner content for 100 wt.part carrier is preferably 2.0 wt.part through 20 wt.part and more preferably 3.0 wt.part through 15 wt.part. If it is lower than the lower limit, the charge-up is induced. On the other hand, if it is higher than the higher limit, the fogging and the toner scattering are induced.

Figure 3A:
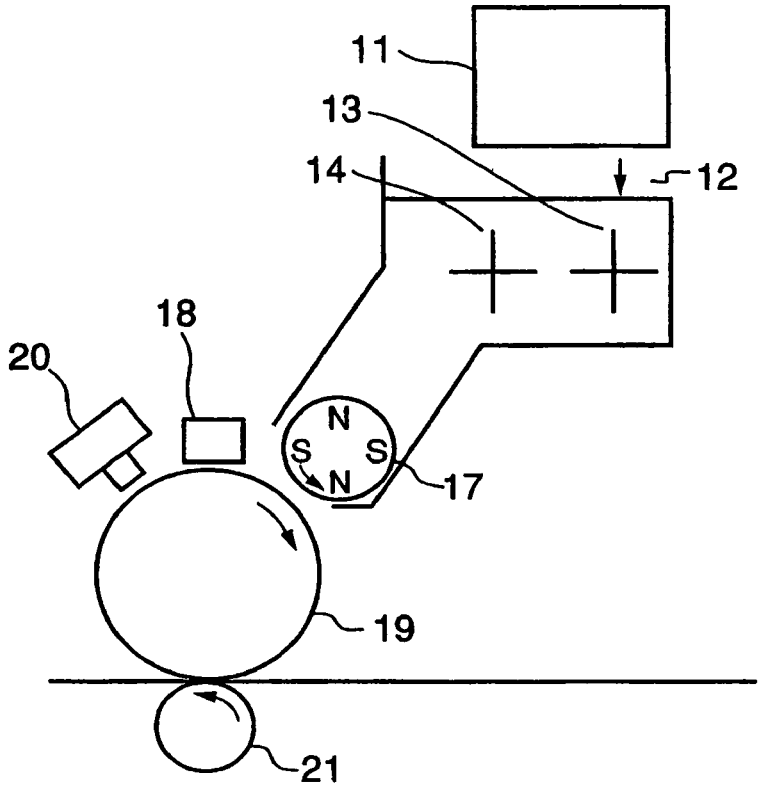
FIG. 3 is a schematic view of a developing apparatus using the toner of the present invention.
Figure 3B:
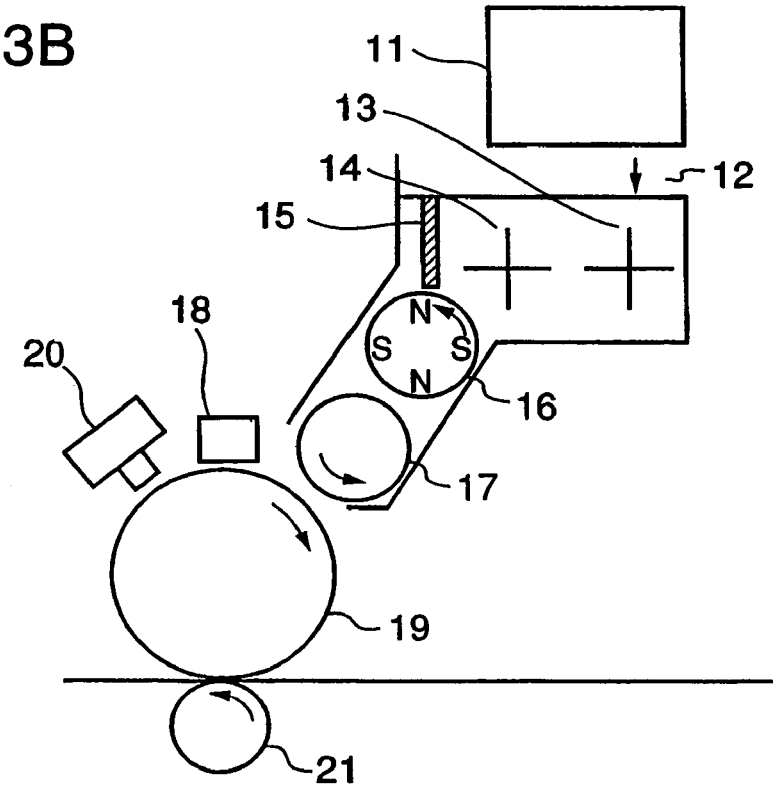
Figure 4:
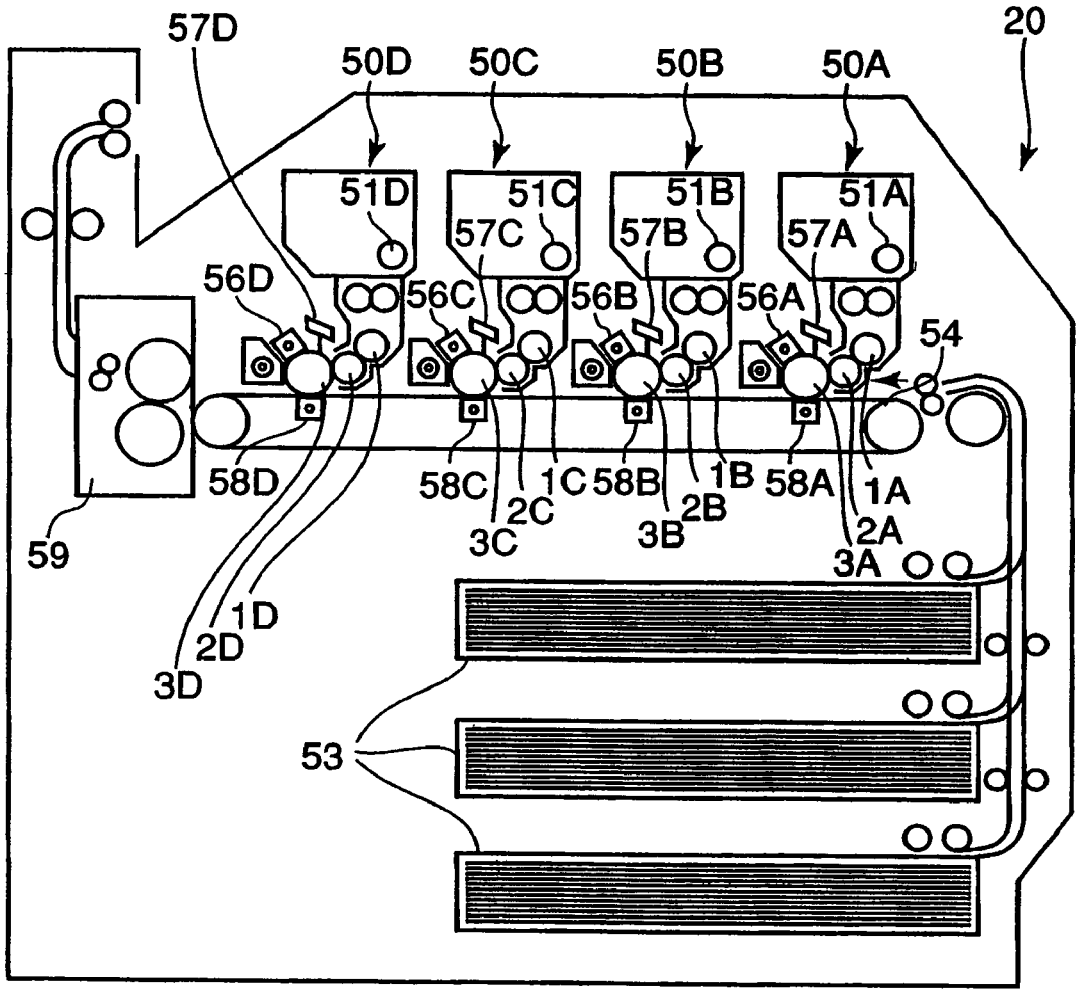
FIG. 4 is a schematic view of an exemplary image forming apparatus using the developing apparatus as shown in FIG. 3.

Next, the image forming method using the magnetic toner 100 is explained, referring to FIG. 3A, FIG. 3B and FIG. 4.

FIG. 3A is a schematic view of the developing apparatus using the toner particle 100 as a carrier-less single component developer. A toner container 11 supplies, from a toner supply inlet 12, a developing roller 17 with the toner particles 100 which are uniformly stirred, mixed and charged together with the magnetic carriers. The toner particles 100 supplied to the developing roller 17 having fixed magnets inside forms a toner thin layer on the development roller 17. The toner particles fly from the developing roller 17 to the photoreceptor 19 distant from the development layer 17, by a development voltage. Thus, the electrostatic latent image is formed. In order to form the latent image, the photoreceptor is uniformly charged by the charging unit 18, and then the photoreceptor 19 is exposed by an exposing unit 20. The developed latent image, i.e., the toner image is transferred by a transfer unit 21 onto the copy paper.

FIG. 3B is a schematic view of the developing apparatus using a two component developer comprising the magnetic carrier and the magnetic toner 100. The toner container 11 supplies, from a toner supply inlet 12, a magnetic roller 18 with the two component developer which are uniformly stirred, mixed and charged together with the magnetic carriers. The magnetic roller 16 forms magnetic carrier ears (magnetic brush) by the fixes magnets inside, thereby attaching the magnetic toners 100 to the magnetic brush. The ear cutting blade 15 regulates the height of the ears of the magnetic carrier within a prescribed length. Further, the toners 100 on the magnetic roller 16 are supplied, by a prescribed voltage, to the developing roller 17 without the fixed magnets. The toner particles 100 supplied to the developing roller 17 forms a toner thin layer on the development roller 17. The toner particles fly from the developing roller 17 to the photoreceptor 19 distant from the development layer 17, by a development voltage. Thus, the electrostatic latent image is formed. In order to form the latent image, the photoreceptor is uniformly charged by the charging unit 18, and then the photoreceptor 19 is exposed by an exposing unit 20. The developed latent image, i.e., the toner image is transferred by a transfer unit 21 onto the copy paper.

FIG. 4 is a schematic view of an exemplary image forming apparatus provided with the developing apparatus as shown in FIG. 3B. However, the developing apparatus as shown in FIG. 3A may alternatively employed.

In the imaging apparatus as shown in FIG. 4, a paper transporting belt 54 transports a recording paper from a paper supply cassette 53 toward a fixing unit 59. Above the paper transporting belt, there are disposed a black developing unit 50A, a yellow developing unit 50B, cyan developing unit 50C and magenta developing unit 50D. In the developing units 50A through 50D, there are provided the magnetic rollers 1A through 1D and developing rollers 2A through 2D, respectively, similarly as shown in FIG. 3B. The developing rollers 2A through 2D face the photoreceptors 3A through 3D, respectively, around which there are provided charging units 56A through 56D and exposing units 57A through 57D.

In place of the tandem color image forming apparatus as shown in FIG. 4, a single color imaging apparatus may be provided, if only one photoreceptor is provided.

The exposing unit 57 may be a semiconductor laser, or LED. About 770 nm wavelength is effective for a positively charged organic photoconductor (positive OPC), while about 685 nm wavelength is effective for an amorphous Si (a-Si) photoreceptor. The positive OPC is stable for a long term, because ozone is generated only a little, the charging is stable, the photosensitivity characteristics are hardly changed, even when its thickness in a single layer structure photoreceptor is decreased by the long term use. The film thickness of the positive OPC is preferably 20 μm through 40 μm, long term use. If it is thinner than the lower limit, an insulating breakdown may be induced remarkably at about 10 μm, thereby increasing black spots in the image. On the other hand, if it is thicker than the higher limit, the photosensitivity is lowered, thereby lowering the image quality.

The charging unit 56 uniformly charges the photoconductor before exposing. The positive OPC charged up to, e.g., 400V is exposed and discharged down to, e.g., 70V, by 770 nm LED. The positive OPC is distant at, e.g., about 250 μm from the developing roller. The wire electrode is not used in the gap space between them. The development roller is of, e.g., electrically uniform conductive material such as aluminum, SUS, conductive resin coating. The developing roller is applied by an AC superposed DC voltage, wherein the Vac is, e.g., Vpp 1.5 kV, 3.0 KHz and duty 30% and the shape of the Vac is preferably square wave. The AC superposed DC voltage excellently develops the latent image. However, the toner left on the developing roller should be regularly stripped off, if the image density for the continuous repetitive printing is to be stabilized.

The toner density of the toner layer is preferably 1.0 $mg/cm^2$. If it is lower than 0.5 $mg/cm^2$, the image density cannot follow a prescribed value and the image density easily becomes uneven, when the high density images are continuously printed. On the other hand, if it is greater than 1.5 $mg/cm^2$, the development ghost and the toner scattering from the developing roller becomes remarkable. The toner layer thickness depends upon the toner charge quantity. The toner layer thickness becomes thicker and the toner scattering is remarkably induced, when the charge is lower than 10 μC/g and particularly lower than 5 μC/g. On the other hand, the toner layer thickness becomes thinner and the toner is excessively charged and the developing capability is lowered, when the charge is higher than 20 μC/g.

When the a-Si photoreceptor is used, the electric potential become lower than about 10V after the exposure. If the film thickness becomes thinner, the saturation electric potential becomes lower and the breakdown voltage is lowered. However, the surface charge density on the photoreceptor is increased and the developing capability is improved. This tendency is particularly remarkable for the layer thickness thinner than 25 μm and preferably thinner than 20 μm for high permeability a-silicon of greater than about 10. Vdc may be lower than 150V and more preferably lower than 100V, while Vac is of Vpp 500V through 2000V and frequency 1 kHz through 3 kHz. On the other hand, when the positive OPC is used, the positive OPC may be thicker than 25 μm and the charge generation agent is more abundantly added, in order to make the residual potential lower than 100V. The charge generating additive is added in the single layered positive. Therefore, the positive OPC has an advantage that the sensitivity is changed only a little, even when the positive OPC single layer thickness is reduced. However, Vdc is preferably lower than 400V and more preferably 300V, in order to avoid to apply a strong electric field on the toner particle 100. The lower developing bias voltage suppresses the breakdown of a-Si, over-charging of the toner particle 100 and the development hysteresis. The clear image is obtained, for example, by the following setting-up that the toner layer on the developing roller is 10 μm through 100 μm and more preferably 30 μm through 70 μm, and the gap between the developing roller and the photoreceptor is 150 μm through 400 μm and more preferably 200 μm through 300 μm. The organic photoconductor as well as a-Si photoconductor is widely used. However, the OPC has a disadvantage that it is soft, thereby easily be scraped by the cleaning blade graze. Therefore, recently, the a-Si which is harder than the OPC is more widely employed, making the best use of the advantages of the endurance and the maintenance free feature. The preferable and popular thickness of the a-Si photoreceptor is 25 μm.

Next, experimental examples and references of the toners and copy image evaluation by using the toners are explained.

First, the preparation of the samples is explained.

Sample Preparation

The sphericity C2/C1 was measured. Here, C1 is the circumferential length of the toner particle image projected on a plane, while C2 is a circumferential length of a circle of an area same as that of the projected image. The toner particles of 20 mg/50 cc are analyzed by the flow type particle image analyzer (FPIA-2100 of SYSMEXCo.Ltd.). Then, the accumulated sphericity distribution for all toner particles were obtained, in order to obtain the average sphericity which is an accumulated median (50% value). The toner sphericity was 0.941 through 0.976. Further, the particle distribution was measured by the above-mentioned FPIA-2100, in order to calculate the number ratio of the fine particles (equal to or greater than 0.6 μm and equal to or smaller than 2.0 μm) by all sample particles (equal to or greater than 0.6 μm and equal to or smaller than 400 μm. The number ratio was smaller than 10%. Here, the above-mentioned circumferential length C1 may be measured by the electron microscope.

The toner components were mixed, fused & kneaded, and ground. Concretely, the toner components were: binder 49 wt.part (styrene-acryl copolymer: molecular weight Mw 47,000 (peak 5,000, 931,000), molecular weight distribution Mw/Mn 29.0, tetrahydroflane (THF) insoluble component 5%, monomer mol. ratio, glass transition temperature Tg 58° C.); magnetic particle 45 wt.part (magnetite containing 1.1 at. % Zn for Fe, average particle size 0.22 μm); wax as parting agent 3 wt.part (sasol wax H1 of SASOL Co. Ltd.), positive charge control agent 3 weight part (calss $4^{th}$ ammonium salt (pontron P-51 of ORIENTCHEMICALS Co. LTD.). They were mixed by the Henschel mixer, were fused & by the two axis extruder, were cooled and were coarsely ground by the hammer mill.

Further, they were finely ground by air flow type or mechanical grinding machine and are classified. Here, the sphericity were adjusted by passing the mixture through the mechanical grinding machine, after grinding the mixture by the air flow type grinding machine.

The following classifying apparatuses can be utilized: such as the air flow type ELBOJET of NITTETSU INDUSTRIES Co. Ltd., or rotational rotor type TTSP of HOSOKAWA-MIKURON Co. LTD.

The shape control process and the surface control process cab be added by a treatment in the grinding process such as passing the mixture a plurality of times in the mechanical grinding machine, or by using a rotation blade impact type powder treatment apparatus such as the hybridization system of NARA MACHINE Co.Ltd., or Impact fine particle grinding machine Of TURBO INDUSTRIES Co.Ltd. The rotating blade type is suitable for the precise control of the particle shape and surface. The heat treatment apparatus (suffusion system) and atomizing sphere manufacturing apparatus can be preferably employed. Further, following various polymerizing methods can be preferably employed: suspension polymerization, solution polymerization, dispersion polymerization, emulsification polymerization, and soap free polymerization.

The measurement of the toner size distribution is explained in farther detail. The KohlterCounter Multisizer 3 (BeckmannKohlter Co. Ltd.) was employed, the electrolyte liquid was Isoton II ((BeckmannKohlter Co. Ltd.), and the aperture was 100 μm. Concretely, the 10 mg sample in the solution of the above-mentioned electrolyte liquid and the surfactant was dispersed by the ultrasonic wave, in order to obtain the volume size distribution of the sample.

Further, the measurement of the carrier size distribution is explained in farther detail. The laser diffraction scattering particle size distribution measurement apparatus LA-920 (Horiba Manufacturing Co. Ltd.) was employed. The range was 5 μm through 100 μm and the dispersion solvent was ethanol.

Finally, the example of the externally added particle is explained. The externally added particles were: 2.0 wt.part titanium oxide EC-100 of CHITAN INDUSTRIES Co.Ltd.; and 1.0 wt. % silica.R a-200H of NIHON AEROSIL Co. Ltd. They were mixed together with the toner particles 100 in the Henschel mixer for 2 minutes.

Next, the experimental results are explained. However, beforehand, the experimental evaluation items and criteria are explained.

Evaluation Items and Criteria

The sample image were printed by the single component jumping development by using the laser printer KM-3830 of KYOCERSMITA Co. Ltd. Wherein the a-Si photoreceptor is provided, with the photoreceptor liner speed 210 mm/s, the linear speed of the developer retaining member (developing roller) 336 mm/s, where the developer roller is of SUS 305, radius 20 mm and average roughness Rz over 10 points 4.5 μ.m.

The sphericity as shown in FIG. 5 was defined by C2/C1, where C1 is a circumferential length of an image projected on a plane and C2 is a circumferential length of an assumed circle of which area is equal to that of the projected image.

The image density was measured for the initial print and the final print. Here, the initial print was the first print for the ISO 5% original, while the final print was the 100,001-th print for the JIS 5% original, after the continuous 100,000 times prints for the ISO 4% original. The image density was measured by the reflection densitometer RD914 of Gretag Mcbeth Co. Ltd. The density was evaluated to be the passing grade, if it is higher than or equal to 1.30.

The toner charge quantity (μC/g) was measured at the initial and final print by the Trek absorption type charge measurement apparatus Q/M meter 210HS of TREK Co.Ltd.

The state of the toner layer was observed for the initial and final print. The evaluation standard were as follows.

○ uniform and no turbulence

Δ a little turbulence but no influence on image quality x turbulence was induced and image was influenced Particularly, image density turbulence was caused in the solid black image.

The photoconductor contamination was evaluated, because something attached or damages cause white or black spots on the developed image. Accordingly, the solid white original and the solid black original were used.

○ no contamination, no damage

Δ a little contamination and damage, no influence on the printed image x contamination and damage were induced and image was influenced The image qualities (fine line reproducibility and transfer fall inside the line or image) ware evaluated for the initial and final print by the optical microscope and the human eyes. The fine line originals were of line length 50 mm with line widths 0.25 mm, 0.5 mm, 1.0 mm, 1.5 mm, 2.0 mm and 3 mm. The transfer fall was evaluated for the initial print and the three continuous prints on the postcards after the continuous 300,000 prints.

○ excellent fine line reproducibility, no transfer fall

Δ fine line reproducibility and transfer fall was bad a little by the microscopic observation, but no influence by the human eye observation.

x fine line reproducibility was bad by the human eye observation, the transfer fall was observed The high stress test for checking the image density maintaining capability during the intermittent printing was executed. At the actual spot in the actual market, several images are outputted intermittently after resting for several minutes through several hours, thereby applying very high stress on the toner. Accordingly, in the high stress test, one print for the ISO 4% original was executed and then one second rest was inserted, repeatedly. The evaluation criteria were the same as the image density evaluation.

Referring to FIG. 5 through FIG. 8, the evaluation results are explained.

Evaluation Results

FIG. 5 is a list of examples and references of the toners for the single component jumping development. There are listed on the table the average particle size, the shericity, the number contents of fine particles, and their fundamental shapes and the tapering degree (tapered in accordance with the present invention (linear portion is left) as denoted by TPI, or heavily tapered (linear portion is not left) denoted as TH). The shape of TH particle is more similar to the sphere (as denoted by SPH) than that of the TPI particle. As shown in FIG. 5, in examples 1 through 4, the average particle size was 7.1 μm through 6.7 μm, the spherity was 0.941 through 0.976, the fine particle number content was 8.2 number % through 9.1 number %.

FIG. 6 is a table of the evaluation results under the ordinary temperature and ordinary humidity (20° C.65 RH %)regarding the image density (continuous printing), image defect, fine line reproductively & transfer fall, image density (intermittent printing) and charge quantity.

All of the examples 1 through 4 showed excellent results regarding all of the evaluation items.

FIG. 7 is a table of the evaluation results under the low temperature and low humidity (10° C.20 RH %)regarding the image density (continuous printing), image defect and charge quantity.

All of the examples 1 through 4 showed excellent results regarding all of the evaluation items.

FIG. 8 is a table of the evaluation results under the high temperature and high humidity (33° C.85 RH %) regarding the image density (continuous printing), image defect and charge quantity.

All of the examples 1 through 4 showed excellent results regarding all of the evaluation items.

What is claimed is:

1. A magnetic toner which internally contains magnetic particles and develops an electrostatic latent image, wherein:

said magnetic particle is of average particle size 0.01 μm through 0.50 μm;

said magnetic particle is of octahedron shape that is a convex polyhedron surrounded by eight triangles as a basis, each of vertexes and edges of the octahedron being in a curved surface shape and having a portion that can be taken as a straight line on the outer periphery of a projected image of said octahedron;

a sphericity of said magnetic toner is 0.94 through 0.98; and a number content of said toner of particle size 0.6 μm through 2.0 μm is smaller than 10%.

2. The magnetic toner according to claim 1, wherein a content of said magnetic particle in said magnetic toner is 35 wt. % through 60 wt. %.

3. The magnetic toner according to claim 1, wherein a first shape of said magnetic particle is of octahedron shape that is a convex polyhedron surrounded by eight triangles as a basis, each of vertexes and edges of the octahedron being in a curved surface shape and having a portion that can be taken as a straight line on the outer periphery of a projected image of said octahedron, and a second shape of said magnetic particle is of not-tapered hexahedron or not-tapered octahedron, or tapered hexhedron or tapered octahedron wherein edges are tapered, wherein: said magnetic particles of said first and second shape are mixed in said magnetic toner; and a magnetization of said magnetic toner is equal to or greater than 2.0 $Am^2/kg$ and smaller than 9.0 $Am^2./kg$ at a magnetic field 79.6 kA/m.

4. An electro-photographic image forming method, using a magnetic toner which internally contains magnetic particles and develops an electrostatic latent image, wherein said magnetic particle is of average particle size 0.01 μm through 0.50 μm; said magnetic particle is of octahedron shape that is a convex polyhedron surrounded by eight triangles as a basis, each of vertexes and edges of the octahedron being in a curved surface shape and having a portion that can be taken as a straight line on the outer periphery of a projected image of said octahedron; a sphericity of said magnetic toner is 0.94 through 0.98; and a number content of said toner of particle size 0.6 μm through 2.0 μm is smaller than 10%, which comprises the steps of:

retaining magnetic toners on a rotating toner retaining member wherein magnets are fixed;

facing said developer retaining member, at a gap, against a latent image retaining member which is an a-silicon photoreceptor; and flying said magnetic toners toward said latent image retaining member, thereby developing said latent image.

* * * * *